United States Patent [19]

Cartabbia

[11] Patent Number: 4,782,609

[45] Date of Patent: Nov. 8, 1988

[54] HANDLE FOR A MANUALLY OPERABLE INDUSTRIAL PRESSING IRON

[76] Inventor: Giovanni Cartabbia, Via Fusline, 36, 25036 Palazzolo Sull'Oglio (Brescia), Italy

[21] Appl. No.: 25,502

[22] Filed: Mar. 13, 1987

[30] Foreign Application Priority Data

Mar. 21, 1986 [IT] Italy ..... 21318/86[U]

[51] Int. Cl.[4] ..... D06F 75/34

[52] U.S. Cl. ..... 38/90

[58] Field of Search ..... 38/90, 91, 92; 16/116 R, 116 A

[56] References Cited

U.S. PATENT DOCUMENTS

| | | | |
|---|---|---|---|
| 2,639,521 | 5/1953 | Rickettson | 38/90 |
| 2,799,102 | 7/1957 | Schott | 38/90 |
| 3,308,566 | 3/1967 | Jepson et al. | 38/90 X |
| 3,672,080 | 6/1972 | Murphy et al. | 38/90 |
| 3,766,673 | 10/1973 | Harroff | 38/90 |
| 4,577,424 | 3/1985 | Liu | 38/90 X |

FOREIGN PATENT DOCUMENTS

| | | | |
|---|---|---|---|
| 442383 | 2/1936 | United Kingdom | 38/90 |

*Primary Examiner*—Louis K. Rimrodt
*Assistant Examiner*—J. L. Olds
*Attorney, Agent, or Firm*—Bucknam and Archer

[57] ABSTRACT

A handle for a manually operable industrial pressing iron has a root portion shaped to fit the facing surface of a handle support of the iron itself, an intermediate rounded, anatomically shaped hand grip portion and a free end portion which is downwardly inclined from the intermediate portion. The intermediate portion has a surface working, at least over that part which is contacted by the palm and fingers of the user, to produce a plurality of closely adjacent microcavities giving the hand grip portion an anti-slip property and allowing air to pass between the hand grip and the hand and fingers of a user to keep it cool during use.

3 Claims, 1 Drawing Sheet

HANDLE FOR A MANUALLY OPERABLE INDUSTRIAL PRESSING IRON

BACKGROUND OF THE INVENTION

Even in industrial situations, where the majority of operations are mechanised or automated, it is still necessary to make use of manually operable pressing irons of traditional structure for pressing some parts of clothing articles Traditional pressing irons, however, have a rather massive, heavy body and it can easily cause the operator to tire, particularly if the handle is awkward or uncomfortable. Moreover, the work station is often very hot due to the heat applied by the pressing iron and this can cause substantial perspiration of the operator, particularly the hand gripping the handle of the pressing iron, and there is also a not insignificant risk of burning if the handle should get extremely hot during use. This fatiguing situation is manifestly brought about by a lack of study of the design of the pressing iron's handle from an anatomical point of view. It is appropriate, moreover, to emphasise that such pressing operations engage workers in the clothing industry for rather prolonged times so that the said disadvantages can detrimentally affect both the physical and psychological well-being of the worker and the manner in which the work is performed.

OBJECTS OF THE INVENTION

A primary object of the present invention is to avoid the above-indicated disadvantages by providing a handle for a pressing iron which will be anatomically shaped to fit the hand of the operator and which will therefore be more comfortable to use and safer in the sense that the shape will make it easier to grip so that slippage is less likely.

Another object of the present invention is that of providing a handle for a pressing iron which will be structured in such a way as to favour an adequate aeration of the palm of the user.

A further object of the present invention is that of providing a handle for a pressing iron the surface of which is treated in such a way as to exhibit anti-slip properties.

SUMMARY OF THE INVENTION

According to the present invention there is provided a handle for a pressing iron, comprising an elongate element having a root portion, a shaped intermediate portion and an unsupported free end portion, the surface of the intermediate portion being worked in such a way as to be anti-slip and to allow an air flow to take place between the intermediate portion of the handle and the palm of the hand of a user.

Various other features and advantages of the present invention will become apparent from a study of the following descriptions of a preferred embodiment, in which reference is made to the accompanying drawings, provided purely by way of non-limitative example.

DESCRIPTION OF THE PREFERRED EMBODIMENT

Figure 1:
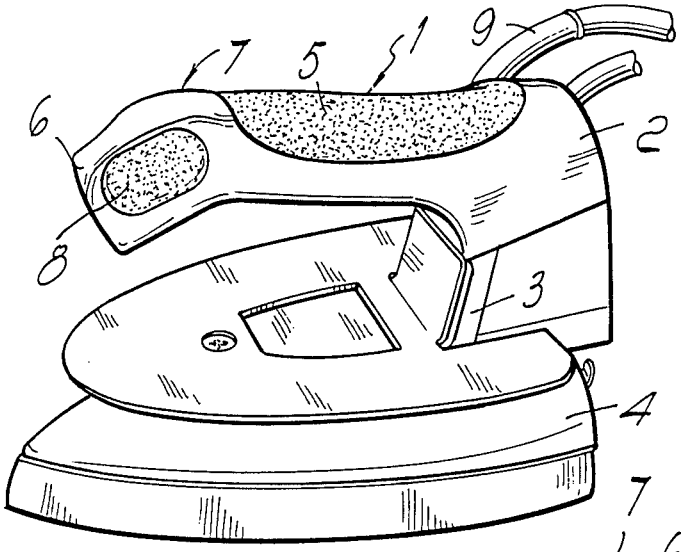
FIG. 1 is a perspective side view of a pressing iron fitted with a handle formed in accordance with the principles of the present invention.
Figure 3:
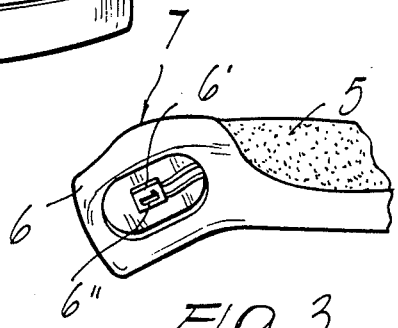
FIG. 3 is a broken away view showing a microswitch included in a free end portion of the pressing iron handle according to the invention.
Figure 2:
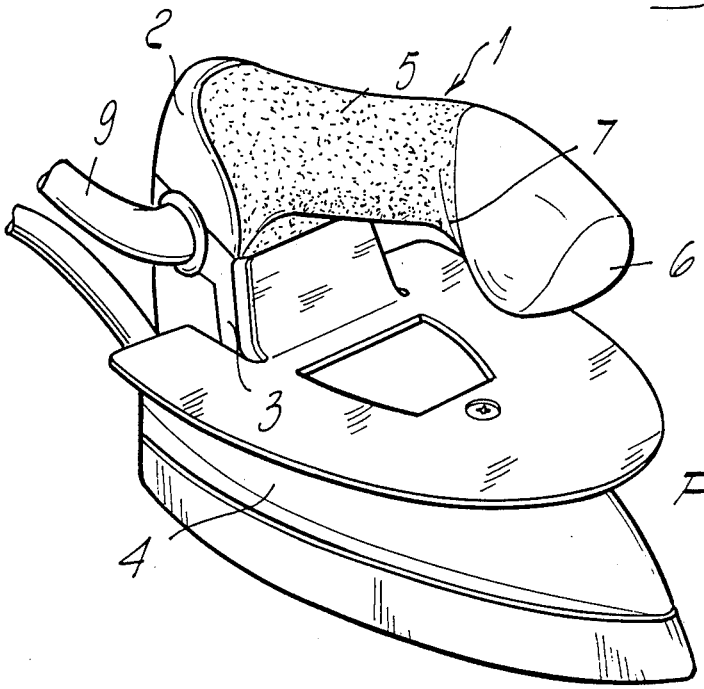
FIG. 2 is a perspective view, from the front and one side of the same pressing iron as in FIG. 1.

With reference now to the drawings, there is shown a pressing iron having a body 4 with an upstanding handle support 3 to which is attached one end of a handle generally indicated with the reference numeral 1, which is preferably, but not exclusively, made of solid wood. The handle 1 has three main portions, namely a central or intermediate hand grip portion 5 intended to be gripped by the user's hand, and having a generally rounded oval section, at one end of which is a root portion 2 having a face shaped to fit onto a corresponding face of the handle support 3 which projects up from the body of the pressing iron 4. Fixing means, such as screws or bolts (not shown) are provided to retain the root portion 2 of the handle 1 in place on the handle support 3.

A part of the surface of the intermediate hand grip portion of the handle 1, namely that part which is contacted in use by the palm of the hand and the fingers (excluding the thumb) of the operator, is treated in such a way as to give it anti-slip properties. This treatment, in substance, involves the creation, by means of chipping or equivalent working operations, of a plurality of closely adjacent microcavities which cause a surface roughness increasing the frictional contact between the skin of the user's hand and the material of the handle 1. These microcavities are also able to allow an air flow past the palm of the hand and the fingers of the hand whilst gripping the handle in such a way as to prevent the build up of excessive perspiration and consequently to render the operator's work more pleasant and to avoid the possibility of dangerous slipping of the handle of the pressing iron with respect to the user's hand which would create a risk of injury or burning of the user or at the very least an unnacceptable degree of imprecision in the pressing work being performed.

The hand support can advantageously be treated with an electrostatic flocking process which in practice, is able to confer on the support itself an adequate thermal insulation able to avoid possible burning of the operator holding the handle 1 in the event of inadvertent contact with the handle support during use. Opposite the support end portion 2 of the handle 1 is a free end portion 6 which is enlarged with respect to the intermediate portion and inclined downwardly. In the vicinity of the region where the index finger of the hand which holds the handle would lie there is a lateral projection 7 against which the index finger presses whilst manipulation of the iron takes place. On the opposite side of the free end portion 6 there is incorporated a microswitch 6'' the operating lever 6'' of which is overlain with a cover 8 of suitable material which is deformable under pressure. This cover 8 is fitted flush with the surface of the free end portion 6 of the handle 1 and is connected to the steam delivery mechanism so that by pressing with the thumb thereon the steam delivery device is actuated.

What is claimed is:

1. A handle for a pressing iron, comprising an elongate element, a root portion of said elongate element, a shaped intermediate hand grip portion of said elongate element and, an unsupported free end portion of said elongate element, the surface of said intermediate portion of said elongate element being worked in such a way as to be anti-slip and to allow an air flow to take place between said intermediate portion of said elongate element and the palm of the hand of a user, said elongate element having an approximately cylindrical shape, said intermediate hand grip portion having a substantially oval cross section, and said root portion, which is intended to be fitted to an upstanding handle support of a body of said pressing iron, having a shape which corresponds to that of the upper face of said handle support, wherein the surface of said intermediate hand grip portion of said elongate element, at least in the region where it is contacted by the palm of the hand and fingers (excluding the thumb) of the operator, is worked by means of one of chiselling, chipping and equivalent working operations in such a way as to form a plurality of closely adjacent microcavities.

2. A handle for a pressing iron according to claim 1, wherein said free end portion of said elongate element is formed as downwardly inclined end portion thereof and is provided on one side, in the vicinity of the index finger of a user's hand, with a lateral projection and on the opposite side with a microswitch having an actuating lever covered with a cover of pressure deformed material, said cover being fitted flush with the surface of said handle so that said microswitch is actuated by pressing with the thumb thereon.

3. A pressing iron according to claim 2, wherein said microswitch under said cover on said free end portion of said handle is connected to steam delivery means energized upon actuation of said microswitch by pressing said cover.

* * * * *